US008773451B2

(12) United States Patent
Marcu et al.

(10) Patent No.: US 8,773,451 B2
(45) Date of Patent: Jul. 8, 2014

(54) COLOR CORRECTION METHOD AND APPARATUS FOR DISPLAYS

(75) Inventors: Gabriel Gheorghe Marcu, San Jose, CA (US); Wei Chen, Palo Alto, CA (US); David W. Lum, Cupertino, CA (US); Jean-Jacques P. Drolet, San Ramon, CA (US)

(73) Assignee: Apple Inc., Cupertino, CA (US)

( * ) Notice: Subject to any disclaimer, the term of this patent is extended or adjusted under 35 U.S.C. 154(b) by 261 days.

(21) Appl. No.: 13/100,146

(22) Filed: May 3, 2011

(65) Prior Publication Data

US 2012/0281008 A1 Nov. 8, 2012

(51) Int. Cl.
*G09G 5/02* (2006.01)

(52) U.S. Cl.
USPC ..... 345/589; 345/63; 345/84; 345/101; 345/690; 348/244

(58) Field of Classification Search
None
See application file for complete search history.

(56) References Cited

U.S. PATENT DOCUMENTS

| | | | | |
|---|---|---|---|---|
| 5,189,521 | A * | 2/1993 | Ohtsubo et al. | 358/296 |
| 5,237,401 | A * | 8/1993 | Koike et al. | 358/518 |
| 6,593,934 | B1 | 7/2003 | Liaw et al. | |
| 7,038,647 | B2 | 5/2006 | Shigeta et al. | |
| 7,271,790 | B2 | 9/2007 | Hudson et al. | |
| 7,321,348 | B2 | 1/2008 | Cok et al. | |
| RE41,191 | E * | 4/2010 | Choi | 345/101 |
| 2005/0007360 | A1* | 1/2005 | Matsumoto | 345/204 |
| 2005/0030397 | A1* | 2/2005 | Nakayama | 348/255 |
| 2005/0122305 | A1 | 6/2005 | Murao et al. | |
| 2005/0140624 | A1* | 6/2005 | Oh et al. | 345/89 |
| 2007/0164931 | A1* | 7/2007 | Miyazaki | 345/63 |
| 2007/0229443 | A1* | 10/2007 | Sawada et al. | 345/101 |
| 2008/0018569 | A1* | 1/2008 | Sung et al. | 345/82 |
| 2008/0284712 | A1* | 11/2008 | Muto et al. | 345/101 |
| 2008/0309684 | A1* | 12/2008 | Sawada | 345/690 |
| 2009/0140125 | A1* | 6/2009 | Takayama | 250/214 R |
| 2009/0322800 | A1 | 12/2009 | Atkins | |
| 2010/0156960 | A1* | 6/2010 | Yi | 345/690 |
| 2010/0238158 | A1* | 9/2010 | Yoshida | 345/214 |

(Continued)

FOREIGN PATENT DOCUMENTS

| | | |
|---|---|---|
| EP | 1675097 | 6/2006 |
| EP | 1973092 | 9/2008 |
| WO | 2007018569 | 2/2007 |

OTHER PUBLICATIONS

Marcu, Gabriel G., Gray tracking correction for TFT-LCDs, Color Imaging IX: Processing, Hardcopy, and Applications. Edited by Eschbach, Reiner; Marcu, Gabriel G. Proceedings of the SPIE, vol. 5293, pp. 277-285 (2003). Dec. 2003.*

*Primary Examiner* — Phi Hoang
(74) *Attorney, Agent, or Firm* — Kendall P. Woodruff

(57) ABSTRACT

Method and apparatus for adjusting the display characteristics of an electronic display, such as a computer or television display. The display is color corrected, e.g., at the factory, to measure its white point correction, gamma and gray tracking correction, and the gain correction over time as the display warms up. Moreover the white point correction and the gamma correction are performed on a per unit basis for each individual display to be manufactured. The resulting correction parameters are stored in memory or firmware associated with the display. Thereby when the display is in use, it performs compensation for white point, gray tracking and gain correction as the display warms up, each time it is powered up or when its thermal operation conditions change.

20 Claims, 7 Drawing Sheets

(56) References Cited

U.S. PATENT DOCUMENTS

| | | | | |
|---|---|---|---|---|
| 2010/0244701 | A1 | 9/2010 | Chen et al. | |
| 2010/0277492 | A1 | 11/2010 | Frederick et al. | |
| 2010/0289835 | A1* | 11/2010 | Holub | 345/690 |
| 2011/0032275 | A1* | 2/2011 | Marcu et al. | 345/690 |
| 2011/0069094 | A1* | 3/2011 | Knapp | 345/690 |
| 2011/0249141 | A1* | 10/2011 | Chen et al. | 348/223.1 |
| 2011/0273404 | A1* | 11/2011 | Noma et al. | 345/175 |
| 2012/0013635 | A1* | 1/2012 | Beeman et al. | 345/590 |
| 2012/0065540 | A1* | 3/2012 | Yarden et al. | 600/549 |
| 2012/0212520 | A1* | 8/2012 | Matsui et al. | 345/690 |
| 2012/0293606 | A1* | 11/2012 | Watson et al. | 348/14.16 |

* cited by examiner

COLOR CORRECTION METHOD AND APPARATUS FOR DISPLAYS

FIELD OF THE INVENTION

This invention generally relates to displays such as used in computer systems, portable electronic devices, televisions, and similar devices and more particularly to correcting the optical characteristics of such displays in terms of representation of gray scale and colors.

BACKGROUND

U.S. Patent Application Publication No. 200/0032275A1 published Feb. 10, 2011, Gabriel G. Marcu, et al., incorporated herein by reference in its entirety, is directed to performing corrections on video data based on the temperature of a video display to produce accurate output values on the display. As explained there, many computing devices, television sets, etc. use an electronic display, such as liquid crystal displays, cathode ray tubes, and organic light emitting diode displays. Typically, such displays show color images, but that is not limiting here. The color response of such displays typically changes as the display operates and particularly as it warms up after being powered up.

As explained there, "white point" (correlated color temperature) shifts along a black body curve as a physical temperature of the display reaches its steady operating temperature. So there is a color shift over time as the display warms up, referred to also as transient color shift. The transient color shift is noticeable often for a quite lengthy period of time, such as up to 2 of 3 hours. This is also the case even if the display is only a black and white display, that is displays only "gray scale". Other parameters of the display may similarly shift as a function of temperature such as luminance, black level, contrast, or the electro-optical transfer function referred to as the "gamma".

The target white point, also referred to as target white, is a set of values that served to define the desired color white for a particular image. Different definitions of target white are needed to give particular optical results. The white point of the display refers to the color that is produced by the display as a response to the maximum digital input on all 3 color channels.

A white point correction refers to a video signal correction that changes the white point of a display to match a target white point.

The target gamma refers to a certain luminance response of the display to the digital input. Target gamma correction typically follows the power law (is an exponential function). Gamma correction is used to encode RGB (red, green, blue) values of the video signals or digital values such that the display response is luminance to the digital input matches the input on all 3 color channels.

However, even the particular correction disclosed in that patent publication can be improved upon, as identified by the present inventors and described following.

SUMMARY

In accordance with the invention not only is the type of gain correction described in Marcu et al. referred to above performed on a display, also performed is "native" gamma correction and white point compensation. Thus, for a display, each of these three corrections is performed. Moreover, the so-called gamma correction may also include what is referred to in the field as gray tracking compensation.

In addition to performing all three of these types of compensation or corrections, further both the gamma and white point correction, are determined on a unit-by-unit basis. The present inventors have determined that the known approach of determining these corrections only for a display on a product or class basis and applying the exact same correction for each individual display unit in that product or class does not provide an optimum correction. This is due to differences in the various individual display units when they are manufactured, due to variations in their components typically. It is known for end users to employ calibrators for performing gamma and white point corrections for their particular display unit. But this is time consuming and requires additional hardware and software.

Disclosed here is a method according to which each individual display is color corrected at the time of manufacture. The correction parameters may be stored in the firmware of the display at the time of manufacture. This correction includes but is not limited to gamma correction, gray tracking correction, white point correction and transient color shift correction. The correction may include the correction for the transient color shift and white point correction and/or gamma correction and/or gray tracking correction. The correction may be but is not limited to display calibration, and may also include certain corrections for optimizing certain rendering conditions, such as for cinema content, video content, photographic content, graphic arts content and so on. The present method may include all these corrections or part of these corrections done at the factory. In the following the terms "correction" and "calibration" are both used.

So in accordance with the invention, each individual display unit as produced in the factory then individually color corrected and thereby is provided with the appropriate correction parameters determined for that particular display for both the native gamma correction and the white point correction. Note that the native gamma correction is also referred to as the optical transfer function. The gray tracking is an aspect or subpart of this gamma correction. The gray tracking herein is present in certain embodiments.

Moreover, in addition, the type of gain correction described by Marcu et al is also provided (not on a unit-by-unit basis), but instead on a basis normalized over a number of units.

Thus, the present inventors recognized the differences between individual display units as manufactured in the factory are significant in terms of their optical characteristics, that is the displayed image as viewed by a user. This is a typical situation. Even though a large number of such display units are produced so as to be uniform, even a relatively casual observer can see that two such units when used side-by-side in fact provide different types of color correction, that is the colors are not uniform unit-to-unit. Of course, this is especially a problem when the display is, for instance, in a computer used by professionals for computer graphics, printing, etc., but even for the consumer this can be an issue. Note that while generally correction, calibration and adjustment of such displays in the factory is well known, this is typically not performed on a unit-by-unit basis, but a single set of correction parameters is used that is uniform over a large number of units as applied at the time of manufacture, such as over an entire class or entire product.

Reference here to "display" or "display unit" is not limited to merely the display panel (screen), but may also include the associated circuitry typically provided with such a display such as a display driver, which is an integrated circuit which actually sources the signals to the display, and the associated video controller circuitry, which may or may not be part of the display itself. Such a display unit may be part of a computer or computing device with which the display is associated. In many cases, however, such displays are external displays such as, for instance, television sets or displays sold to be connected to a separate computer system in which case the display also includes the relevant controller circuitry.

Disclosed here is a first method typically performed in a factory or similar facility where such displays are manufactured or integrated into another parent system such as a computer system or television set. The compensation or correction is performed as described above on each display unit as it is manufactured or installed in the parent system. The actual order of which type of compensation is applied in terms of the above-described gain correction of Marcu et al., the white point compensation, and the gamma correction varies depending on the particular embodiment. Moreover, unlike in Marcu et al., here the gain correction, which is performed over a range of temperatures, is normalized over a number of units. Note that it is generally not practical to perform the Marcu et al. type gain correction for an individual display unit. So instead a generic transient compensation is determined, which is then mathematically normalized. This transient compensation is derived from a previously calibrated display used as a standard.

In Marcu et al. the chief independent variable for determining the amount of gain correction at any time is the temperature. The display in that disclosure, see FIG. 8, includes a temperature sensor coupled to a heat sink and in thermal contact with the display screen so as to measure the temperature of the display. The actual gain correction thus is a function of temperature, not of time. It is understood, however, that the physical temperature (the actual temperature, not the so-called color temperature) increases over time as the display and/or its associated system warm up. A typical full warm-up period is much as 2½ hours.

In accordance with the present invention, in certain embodiments instead of using a single temperature sensor as shown in that disclosure, a synthesized or "virtual" temperature value is determined, which is the combination of several temperatures measured or estimated at several different points on the display combined with other factors such as the air circulation through the system as, for instance, provided by a fan or other air cooling. Thus, this synthesized or virtual temperature is used as the independent variable to determine the amount of gain correction provided rather than a single measured temperature. The intent is to calculate this virtual temperature so that it corresponds to the physical temperature at the center of the display screen. This is done even though no such temperature sensor is actually present at that point; hence, the term "virtual."

In addition to the method, also provided is an associated test or calibration apparatus to perform this method, typically operated by factory personnel. This apparatus includes an optical pickup adapted to receive an optical or at least one signal from a display under test; a color measuring device coupled to the optical pickup to analyze the optical signal; and a test unit coupled at an input port of the color measuring device to determine, from the analyzed optical signal, at least one of a gamma correction, a white point correction or a gray tracking correction, and to determine a set of gain corrections for a plurality of temperatures, and having an output port adapted to be coupled to the display under test to transmit the corrections to the display under test.

Moreover, as in Marcu et al. there is provided associated circuitry in the display to perform the corrections (compensation) when the display is in use by the end user. This circuitry includes certain additional circuitry and/or modifications to the conventional controller video present in or associated with such displays, including the temperature sensor or sensors and associated micro-controller and other logic or firmware. In some embodiments, this circuitry is in a form of an integrated circuit such as an Application Specific Integrated Circuit (ASIC) or a Field Programmable Gate Array (FPGA). In other cases, this functionality is carried out by firmware or software executed by the controller, which is, for instance, a micro-controller or micro-processor conventionally associated with a display and in some cases, installed in the display.

Also, therefore, provided in accordance with the invention is an external-type display or stand-alone display such as a television set or external computer display, including the relevant circuitry plus the display screen. Also, contemplated is a computer system or other system, including the display, the controller, temperature sensor, and other conventional features, for instance, in the case of a computer system, a central processor, graphics processor, memory, and an input device such as a keyboard or mouse, etc.

DETAILED DESCRIPTION

Figure 1:
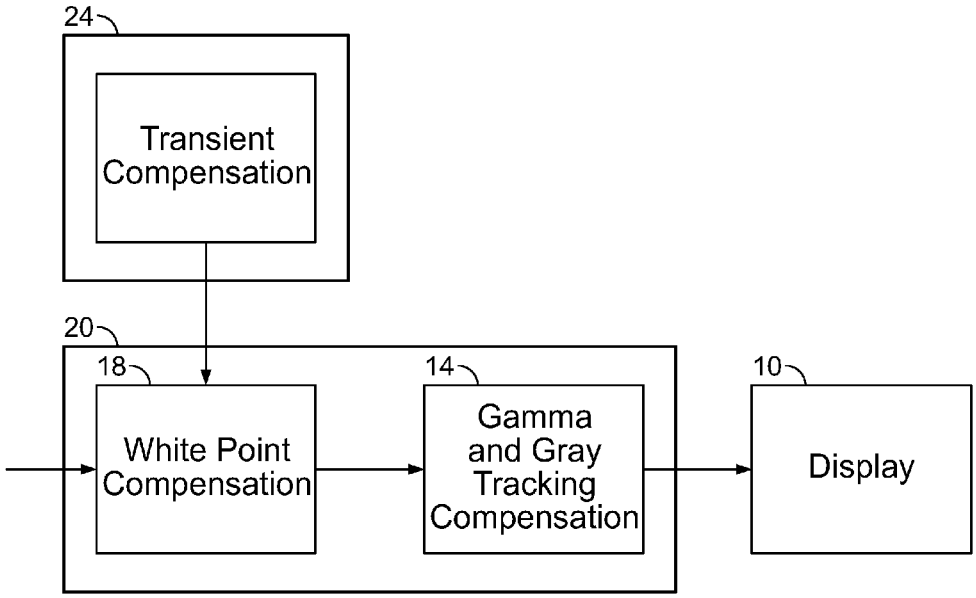
FIG. 1 shows graphically a color correction in accordance with the invention.

FIG. 1 depicts graphically a color correction method for a display 10 in accordance with the invention. This is a conventional display 10 as described above, but not so limited. The goal is to improve color/gray scale control for the well-known optical transfer function (also referred to as native gamma), the white point or color temperature, and the transient color shift referred to as gain correction in Marcu et al referred to above, while preferably having less dependency on software in the display to perform the corrections when the display is in use. The so-called gamma or native gamma or optical transfer function includes, as described here, two aspects in terms of visual effects. One is gamma also referred to as gray scale difference and the second is gray tracking, which is the color in terms of the grays, that is intensities. These are conventional measures of display images.

Hence the color correction method is typically performed as described above in a factory where the display (or its parent system) is manufactured and/or assembled. First, the display unit, also sometimes referred to as a "panel" in the field, which is conventional except as described herein, is provided. In one exemplary color correction method, first the gamma and gray tracking compensation are provided at step 14 in FIG. 1. This calibration is provided for the each individual display unit 10 so each individual display unit will have a unique set of correction values. The gray tracking and gamma corrections are performed for the entire display screen, using measurements taken at the center of the screen. Thus, each display unit in a large number of such being produced will have a slightly different set of corrections. This, of course, requires measuring the performance of the individual display during the manufacturing process and determining appropriate correction values. The actual measurements and corrections are essentially conventional. Details of suitable correction algorithms are in U.S. Pat. No. 7,777,760, Marcu et al., incorporated herein by reference in its entirety, and in "Gray Tracking for TFTLCDs", SPIE/IS&T Color Imaging Conference, EI Symposium, San Jose, Calif., January 2004. The result of the correction is a table where the input is gray levels from 0 to e.g. 1,024 and the output values are the RGB pixel values that will produce the target color.

Next in this particular embodiment, the white point correction is performed at step 18. Again, this is done on a for each individual display unit 10. The white point correction is one particular case of the gamma and gray tracking correction, so the same algorithm is used. The white point correction is equal to 1 for the maximum gray level value, but for a target white point different from the "native" white point of the screen.

This per unit calibration for both the white point compensation and the gamma and gray tracking compensation are advantageous. The present inventors determined that there are significant differences between individual displays even though they are manufactured to be identical in terms of their optical performance and especially their color and gray scale performance. Hence, this per unit calibration 20 is shown in FIG. 1. The order of steps depicted in FIG. 1 is not limiting. Again, the actual white point compensation or calibration process is conventional using the apparatus described below.

Next in FIG. 1 the transient compensation 24 which is a type of gain correction but which may be somewhat different than that of Marcu et al and is also based on temperature is provided. As explained above, in one embodiment this is somewhat uniform for a number of such displays since it is currently not practical to determine the actual transient compensation for each individual display unit. This temperature compensation, thereby is normalized. An example of such a normalization process is as follows. The gamma correction and gray tracking corrections are performed in the first step of color correction. Gamma correction and gray tracking correction algorithms are used for computing the transient color shift correction. The transient correction is then normalized relative to the temperature value at which each unit is individually color corrected for the gamma and gray tracking. The transient color shift correction for the display operates continuously, not only at the display's warm up time but also whenever the thermal operation conditions of the display change.

A computer text file is used to report the RGB values used for the white point correction. In this example of normalization, these RGB values (expressed in 12 bit coding) are 8000, 7cca and 7738 for the red, green, blue (RGB) color channels respectively. A temp value designated T, representing the temperature at which the display unit is warmed up, is reported in the computer text file in the first two reserved bytes after the RGB values, as follows:

1. first byte (b1)=the integer part of the temp T value
2. second byte (b2)=2 digits of the fractional part of the temp T value For example, T=49.73 C is coded with the following 2 bytes: 0x31 0x49. An example of the text file (with comments indicated by the // notation) including this coded T value is:

```
// start code: 0x55a7aa; version: 0x03
55
a7
aa
03
// R G B
8000 7cca 7738
// temp
31
49
00
00
// checksum
00
00
```

The following equation is then used to calculate the normalized value:

$$\text{deg C.}=\text{deg C.}*(Tn-T0)/(T-T0)+T0*(T-Tn)/(T-T0);$$

where T=the temp value T, and T is reported in first and second reserved bytes of the text file. T is calculated as: T=dec(b1)+dec(b2)/100, where dec (b) is decimal value of the byte b, T0=25, and Tn=in a table (where not all RGB values are equal to 0xFF) for the selected display. Tn is the smallest temperature value in the variable designated ThermalDataPoint for which the following conditions are satisfied:

a. coefficients.red=coefficients.green=coefficients.blue=0xFF, and
b. T0<Tn<TMP42x_DEVICE_MAX_TEMPERATURE.

For example, for a particular display table:

```
ThermalDataPoint const TABLESPACE table [ ] =
{
    { TMP42x__DEVICE__MIN__TEMPERATURE, { 0xD600, 0xDF08,
    0xFFFF } },
    { TEMPERATURE(5, 0),        { 0xD600, 0xDF08, 0xFFFF } },
    { TEMPERATURE(20, 0),       { 0xE550, 0xEAC0, 0xFFFF } },
    { TEMPERATURE(25, 0),       { 0xEA22, 0xEEAB, 0xFFFF } },
    { TEMPERATURE(30, 0),       { 0xED96, 0xF23B, 0xFFFF } },
    { TEMPERATURE(35, 0),       { 0xF181, 0xF55D, 0xFFFF } },
    { TEMPERATURE(40, 0),       { 0xF5F0, 0xF8D1, 0xFFFF } },
    { TEMPERATURE(45, 0),       { 0xFAA2, 0xFC15, 0xFFFF } },
    { TEMPERATURE(47, 0),       { 0xFC40, 0xFD61, 0xFFFF } },
    { TEMPERATURE(50, 0),       { 0xFF8F, 0xFF80, 0xFFFF } },
    { TEMPERATURE(51, 0),       { 0xFFFF, 0xFFFF, 0xFFFF } },
    { TEMPERATURE(70, 0),       { 0xFFFF, 0xFFFF, 0xFFFF } },
    { TMP42x__DEVICE__MAX__TEMPERATURE, { 0xFFFF,
    0xFFFF, 0xFFFF } }
};
T0 = 25, Tn = 51.
```

Value Tn can be determined programmatically or can be hardcoded into each display unit.

Figure 2:
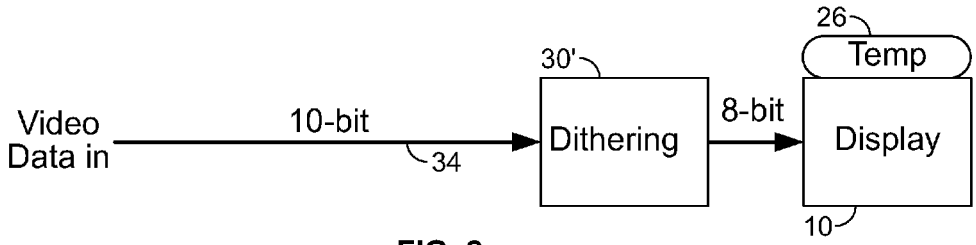
FIG. 2 shows generally a color correction in accordance with the invention.

FIG. 2 illustrates graphically how each of these compensation processes is performed where display 10 has an associated conventional temperature sensor 26. The temperature measurement is only used for the transient (gain) compensation, not for the white point or gamma corrections. Also provided in the display or associated therewith is a conventional dithering circuit 30 or equivalent firmware which is driven by conventional video data provided on a 10-bit (per pixel, per color, 30-bit per pixel total) bus 34. Dithering circuit 30' reduces the input 12 bits of data (per pixel, per color channel) to 8 bits as is conventional since typically the display driver (not shown) can only accept these 8 bits. Of course, this number of bits is merely exemplary. Such a dithering device or element is well known in the field and is conventionally part of, for instance, the display controller shown in FIG. 9 of Marcu et al. Conventionally such dithering components or circuits "dither" an n bit input value to produce an n-m bit output value. Further, the reference here to the number of bits refers to each color channel such as red, where typically there are three color channels—red, green, blue (RGB). For purposes of simplification here, only one of the color channels is illustrated. Thus typically the actual video data is provided as a 30-bit (per pixel) video data in on bus 34 and a 24-bit output (per pixel) value to display 10.

Figure 3:
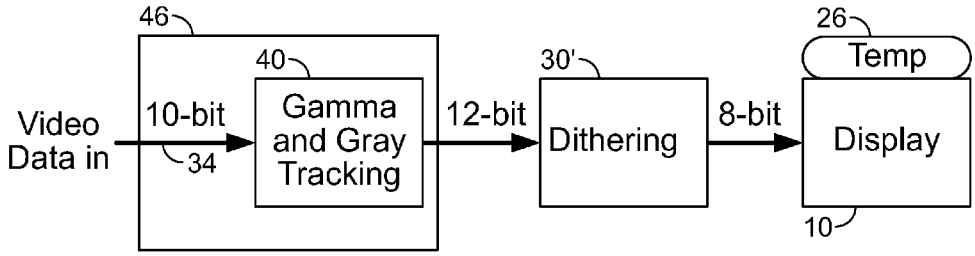
FIG. 3 shows applying the gamma and gray tracking compensation or correction.

FIG. 3 shows the result of the process of FIG. 2; where additionally the gamma and gray tracking correction are carried out in element 46 at 40. Here the gamma and gray tracking compensation 40 add two bits (per color channel per pixel) and the dithering component 30 reduces its 12-bit input to an 8-bit output for each color channel.

Figure 4:
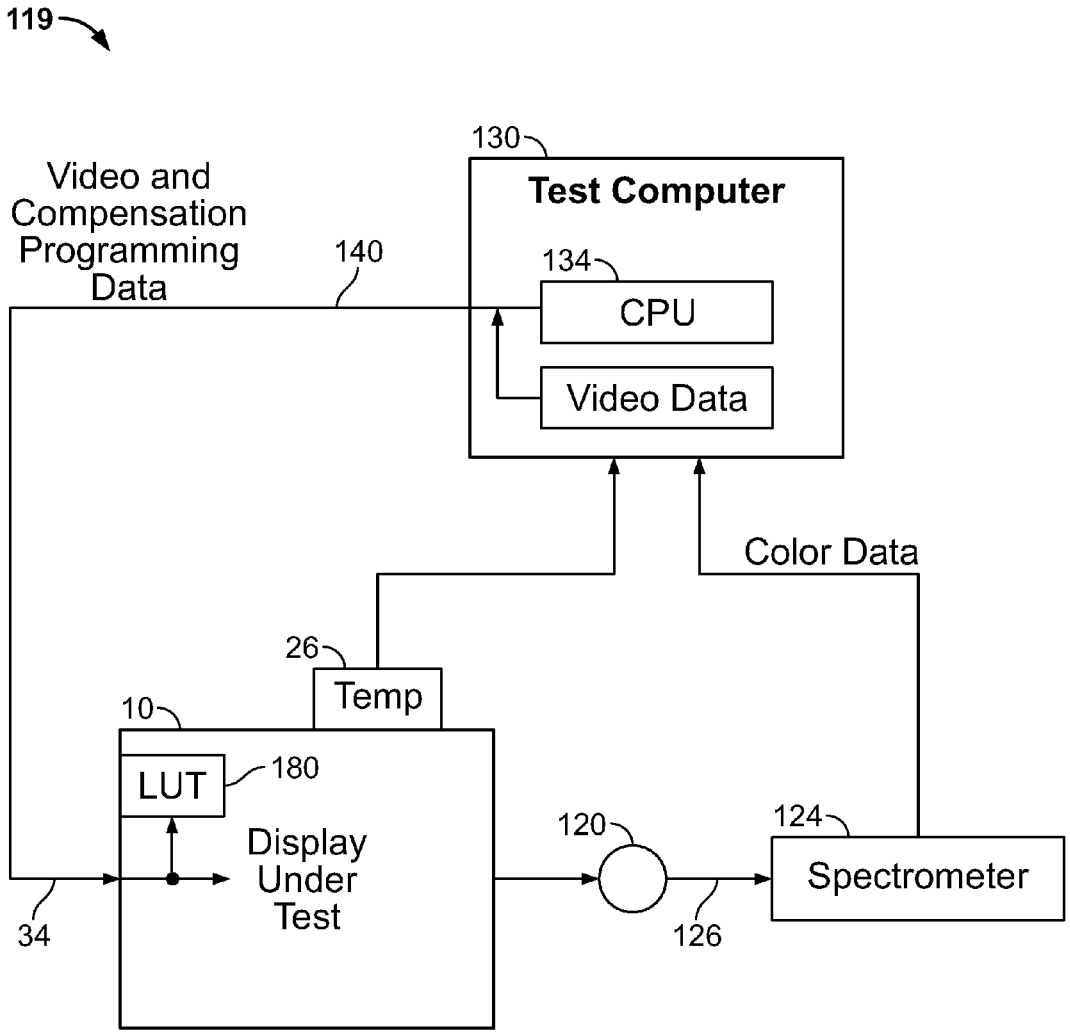
FIG. 4 shows a test or calibration apparatus in accordance with the invention.

FIG. 4 shows such a display 10 including the temperature sensor 26 when it is under test, that is subject to the above described factory calibration. As shown, video input data is provided from a source associated with the test computer 130 and coupled to video input bus 34 to provide an image on display under test 10. Display under test 10 then outputs light from the displayed image as indicated by the arrow, which in this case impinges upon the conventional optical pick up 120 associated with a conventional optical measuring instrument 124 and connected thereto by cable 126. The optical measuring instrument is a spectrophotometer, a colorimeter, or any type of color sensor typically used in conventional color measuring device. The color measuring device 124 and pick up 120 are wholly conventional. The color measuring device 124 then transmits the resulting color data, in whatever form is useful (typically in terms of digital data) to test computer 130 and which also includes a conventional CPU (central process unit) 134 and all the other conventional elements of a computer such as volatile memory, non-volatile storage, interfaces, etc.

CPU 134 executes software which computes the transient compensation, white point compensation and gamma compensation as shown in FIG. 1 and outputs the resulting compensation programming data on its output bus 140 which is routed to the communications channel of the video input port of display under test 10, where this data is routed to and stored in a look up table (LUT) or several LUTs typically stored in a programmable read-only memory 180 which is a component of the display under test. Test apparatus 119 shown in FIG. 4 is suitable to carry out the method depicted graphically in FIG. 1.

Figure 5:
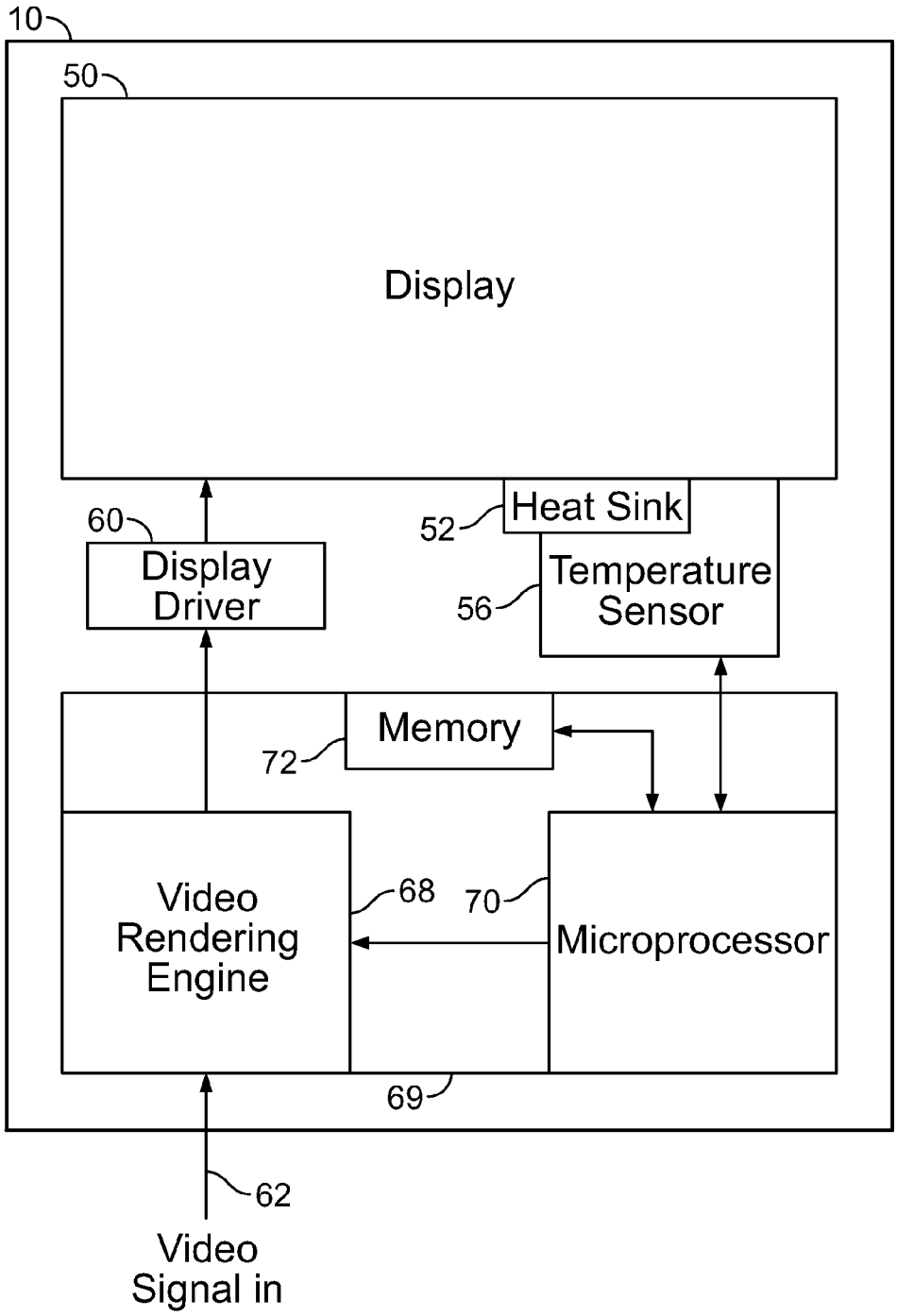
FIG. 5 shows a display apparatus in accordance with the invention, including a processor.
Figure 8:
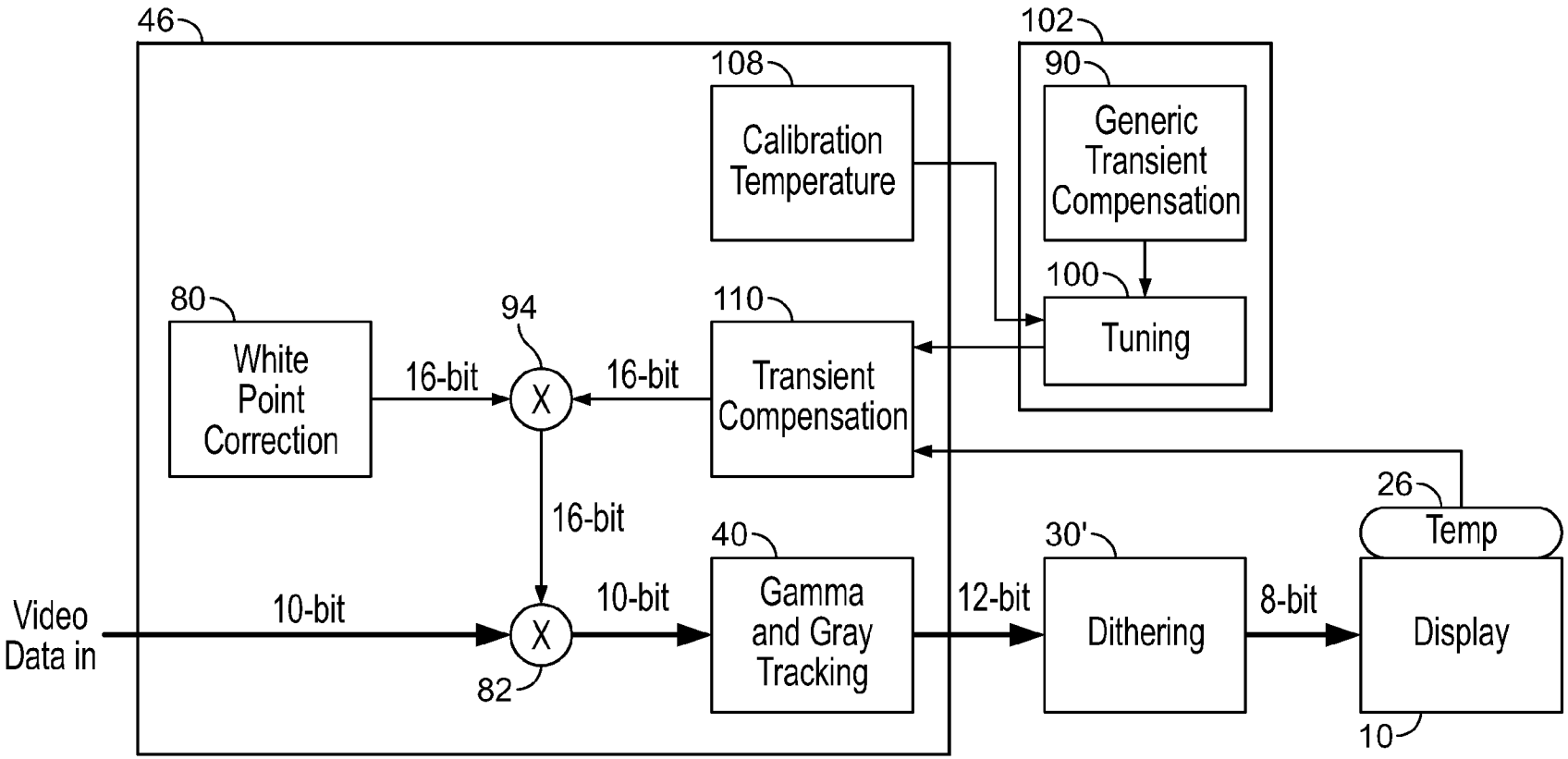
FIG. 8 shows additional detail relating to FIG. 7.

FIG. 5 is essentially the same as FIG. 8 of Marcu et al. and shows display 10 in greater detail in a block diagram. Of course, this is merely exemplary and is at the block diagram level. Display 10 includes the actual display panel such as an LCD panel or cathode ray tube 50. This has a conventional associated heat sink in thermal contact with the display panel 50 and in which is in thermal contact the temperature sensor 56. Also provided is a conventional display driver 60 such as an integrated circuit of the type conventionally available, which is conventionally driven by the video signal input at input terminal 62. Display driver 60 is thereby driven by a video rendering engine (processor) 68, which again is conventional and part of video rendering chip 69. This particular display 10 is also provided with a micro-processor 70 and associated computer readable memory 72. Some display units do not include all these elements. Further, the video rendering or graphics chip 69 may be provided separate from the display device 10.

Figure 6:
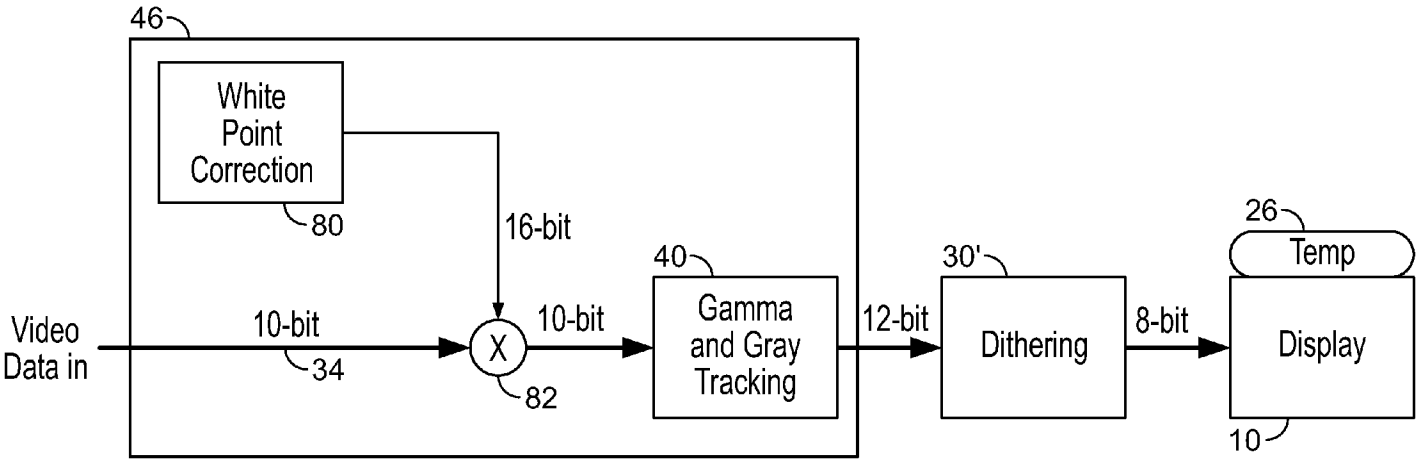
FIG. 6 shows in a high-level block diagram the gamma and gray tracking correction as applied to the display apparatus of FIG. 5.

FIG. 6 shows additional aspects of FIG. 3 and further includes the white point correction 80. In FIG. 6, in order to add the white point correction values to the incoming video data, on bus 34 a multiplier 82 is provided. Multiplier 82 is a conventional logic or firmware element. Thus, the white point correction is combined with the input video data in on bus 34 by multiplier (combiner) 82 and the result is provided on the 10-bit bus to the gamma and gray tracking correction element 40. Use of a multiplier to combine the video and correction values is not limiting.

Figure 7:
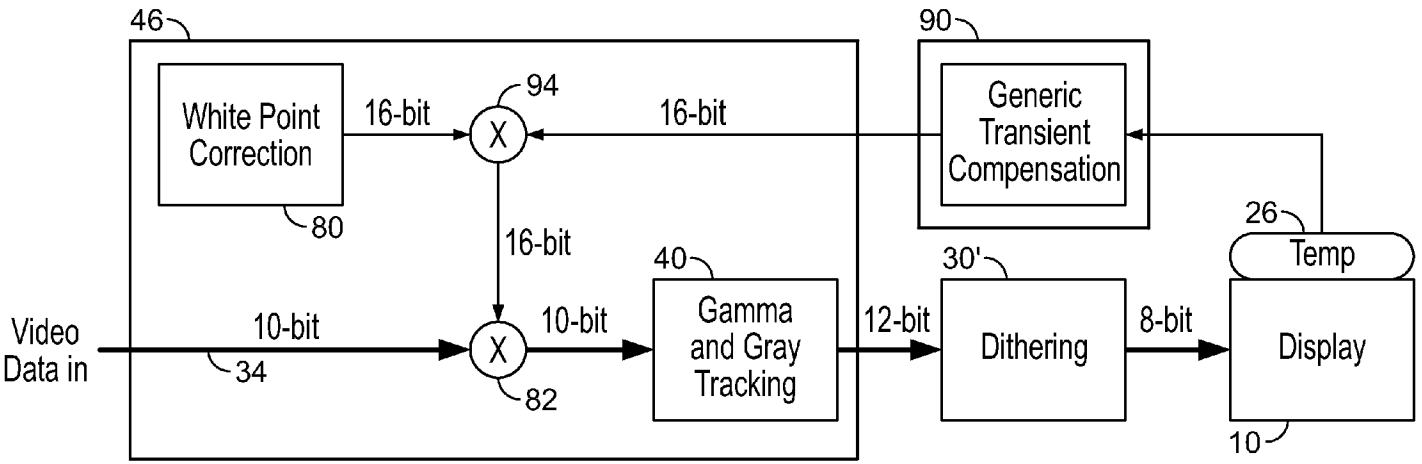
FIG. 7 shows the gain correction over time applied to the display device of FIG. 5.

FIG. 7 shows, in addition to the elements shown in FIG. 6, the "generic" transient (gain) compensation process (calibration) which is the type of compensation applied by Marcu et al., (where "generic" means common to a large number of similar display units) over a plurality of sampled temperatures during the warm up period and determined as described in Marcu et al. as a function of the temperature, as measured by temperature sensor 26. These 16-bit correction values 90 are provided to a second multiplier 94, which combines them with the 16-bit white point correction values from element 80.

FIG. 8 shows elements of the color correction in addition to those of FIG. 7, including a tuning element 100 associated with the generic transient compensation 90 of FIG. 7. Further provided is a temperature element 108 which drives the tuning element 100 and in turn the tuning element 100 provides the tuned generic transient compensation values from element 90 to a transient compensation algorithm 110 which in turn drives the multiplier 94. As shown here, temperature sensor 26 provides the temperature input to the transient compensation algorithm 110. In general with reference to FIG. 8, the compensation provided by element 46 is per display unit, and the compensation provided by element 102 is initially generic, then normalized or tuned. Hence, the generic transient compensation provided by block 90 as tuned by block 100 provides a normalized transient compensation 110 in terms of a set of values typically stored in look up tables, as further explained below.

Figure 9:
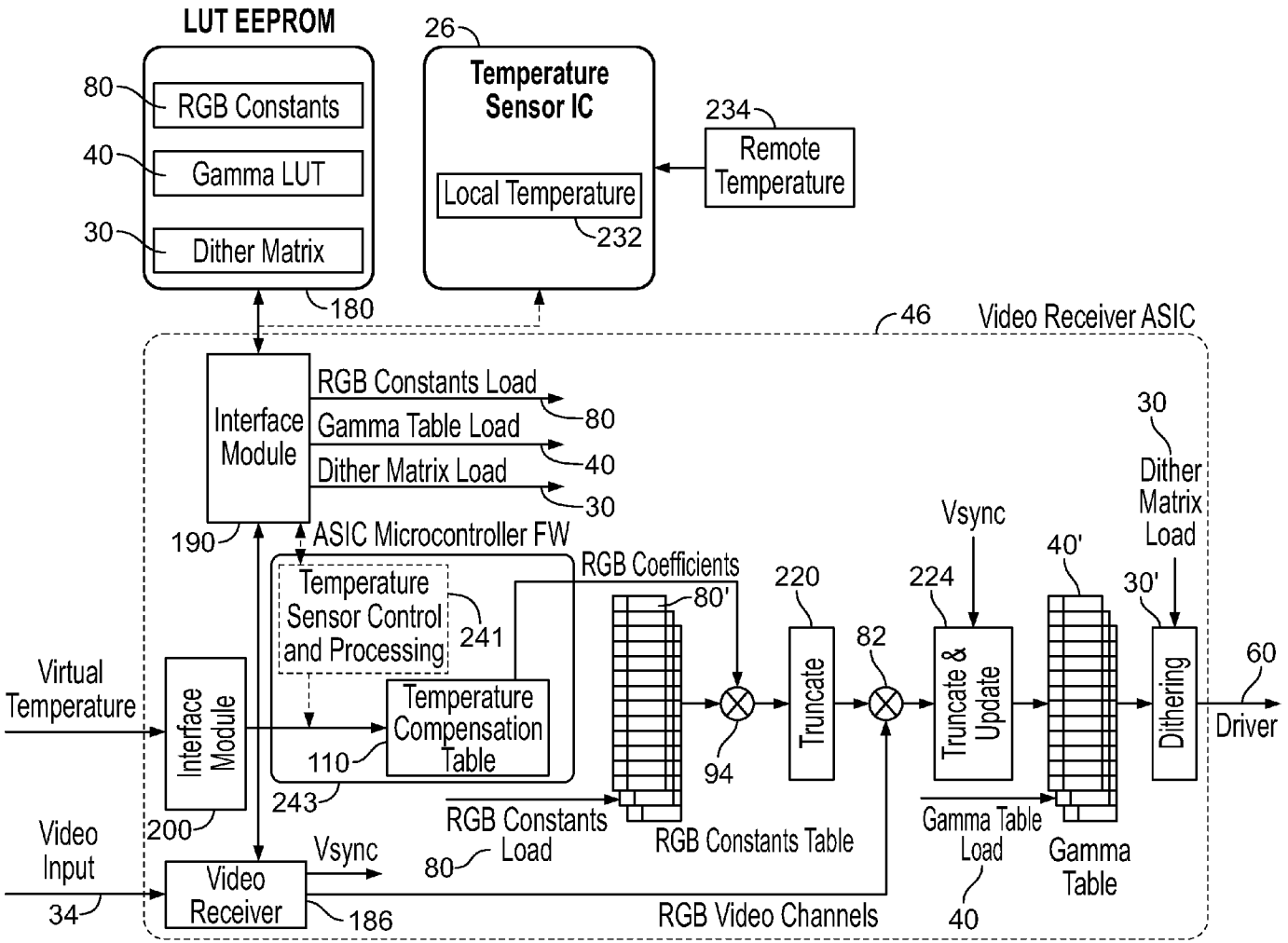
FIG. 9 shows in greater detail a block diagram of a video processor or controller as used in the display apparatus of FIG. 5.

FIG. 9 shows further detail of the functionality of element 46 of FIG. 8 in the form of a controller circuit 46 combined with the dithering element 30' which is previously loaded from the Dither Matrix 30 stored in EEPROM 180. Similar elements as in FIG. 8 are identically labeled. In this case the gamma and gray tracking compensation values 40 shown in FIG. 8 and the similar white point correction values ("RGB Constants") 80 in FIG. 8 are stored in an electrically erasable programmable read-only memory (EEPROM) 180 which in this example is an integrated circuit (IC) separate from that of the controller 46.

Video receiver 186 receives video in data on bus 34. Video receiver 186 is coupled to the conventional interface module 190 as shown to provide programming of the LUTs in memory 180 via a data communications channel of bus 34. Video receiver 186 communicates the incoming programming data to interface module 190 via this connection to update the white point and gamma correction values in EEPROM 180, as described above with reference to the calibration process.

At the bottom left of this drawing, the virtual temperature (or other temperature input) as determined as described hereinafter is provided to an interface module 200. This temperature data in turn is used to look up the transient compensation values stored previously in the table of memory 110. The output port of the multiplier 94 is coupled on a 32-bit bus (per color channel) to a truncator 220 to truncate this value to its 16 most significant bits, then to be combined at multiplier 82 with the 10 bits (per color channel, per pixel) of the input video data. This input video data is provided from the video input of bus 34.

A second truncator and updater element 224 is conventionally latched by the video vertical sync (synchronization) signal provided in the input video data on bus 34. Truncator 224 then provides a 10-bit output to the gamma tables 40' (per color channel, per pixel) which were previously loaded from the gamma LUT 40 in the EEPROM 180. Similarly the RGB Constants 80 (also referred to above as the white point correction constants) from the EEPROM 180 are loaded into the RGB Constants register 80'.

The virtual temperature data applied via the interface circuit 200 is not the same as the actual temperature measured for instance in FIG. 8 by temperature sensor 26. Instead this virtual temperature is a synthesized value. It is, e.g., a function of several temperature measurements taken at various locations on the display or parent system by several independent temperature sensors. For instance there is a temperature sensor on the backlight of the display panel (if such is provided), a sensor for ambient temperature, a sensor for the temperature of the system microprocessor, and for instance the air flow temperature determined for instance by a fan which may be cooling the entire display unit 10 or parent system.

The goal is to synthesize all of these inputs into a virtual temperature which is a close approximation of the actual physical temperature at the center of the display screen. Instead of using a virtual temperature, controller 46 includes the option to use the temperature reading from a local temperature sensor 232 and remote temperature sensor 234 by sampling the IC temperature sensor 26. The input temperature data is coupled to the interface module 190. The controller firmware 243 controls temperature sensor 26. This firmware 243 includes instructions for sensor control and processing at 241. This firmware also includes instructions as an option to read temperature sensor 26 at the time of the initial video input on bus 34 (e.g., when the display is powered up) and then later use the virtual temperature. This dual temperature approach (local temperature and then later virtual temperature) would also occur when the display has been in its sleep mode or when the parent system has been in its sleep mode. This option prevents color shift on the initial images that are displayed after the power up or transition from a sleep mode.

Figure 10:
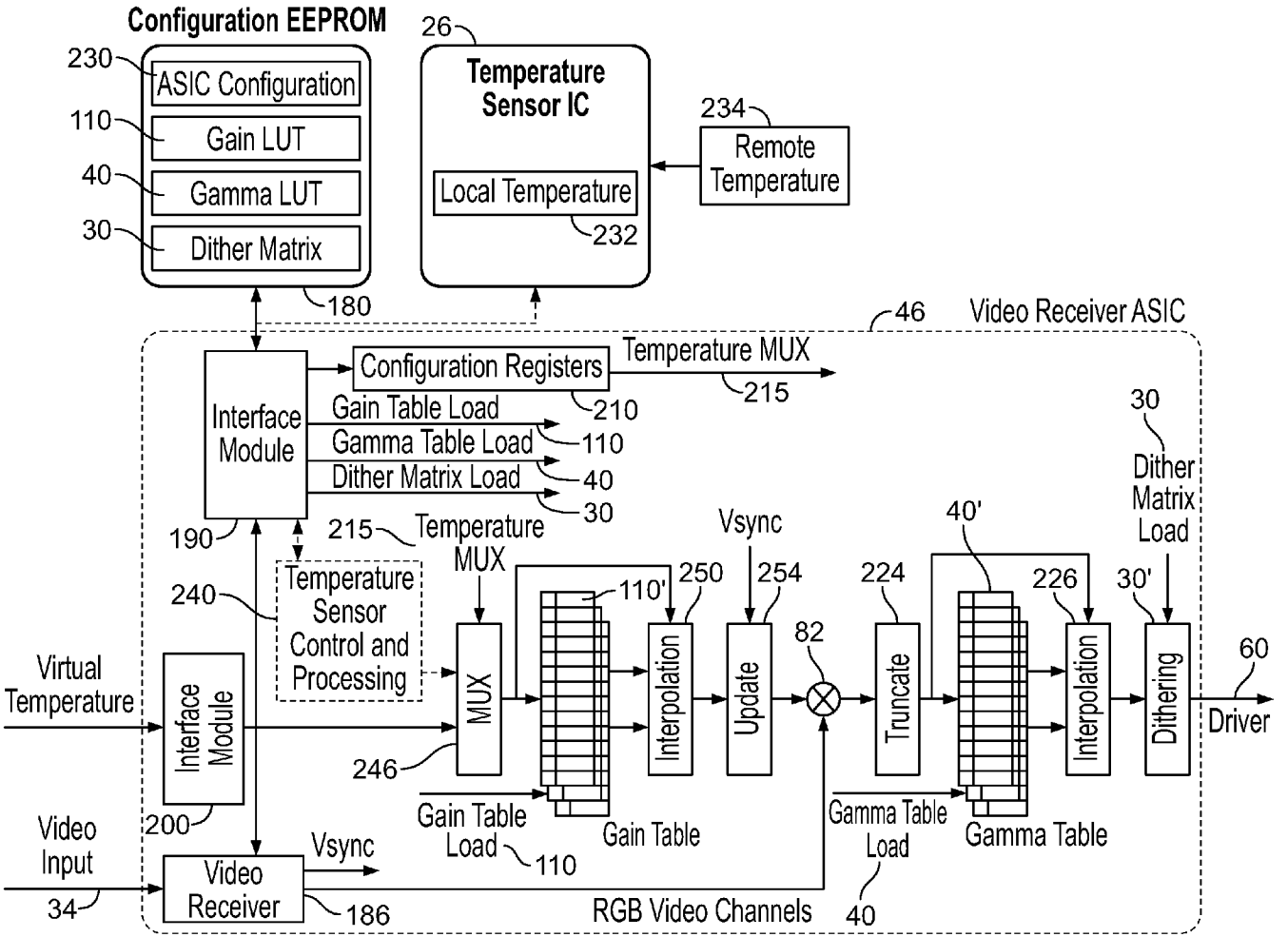
FIG. 10 shows a variant of the FIG. 9 device.

FIG. 10 shows a variant of the device of FIG. 9 with similar elements identically labeled. In this case the (external) read only memory 180 also includes a set of configuration bits 230 which store information for configuring controller 46.

In another aspect of the use of temperature, the RGB Constants 80 have an optional default temperature value. At the time of the initial video input (as explained above) this default temperature value is used to look up the appropriate transient compensation values. After that again the virtual temperature is used.

If the configuration bits specify use of temperature sensor 26, the Temperature Sensor Control and Processing module becomes active. Interface module 190 provides a communications link between this module and the temperature sensor 26. The output of processing module 240 is a 7-bit value input to a multiplexer (MUX) 246 also receiving the virtual temperature which is a 7-bit signal provided from the host system in this embodiment. The measured or virtual temperature signal as provided from multiplexer 246 (selected by a Temperature MUX signal 215 set by Configuration Registers 210) is then applied to the gain table 110' which stores the data from the gain look-up tables 110. This embodiment thereby has the option to select the virtual or local/remote temperature as the input variable to look up the transient compensation. The output of MUX 246 determines what value is looked up by gain table 110. In this embodiment, the gain LUTs 110 also store the white point correction values combined with the gain values, to simplify the circuit. Also provided here is an interpolation circuit 250 to interpolate if the particular input temperature is not found at the exact value at the table 110', so instead interpolation is used as in Marcu et al.

This interpolation value is latched by an updater 254 driven by the vertical sync signal of the incoming video signal on bus 34. Here the RGB video channels are applied via video receiver 186 which applies 8- of 10-bit video (per color channel, per pixel) to multiplier 82 to be multiplied by the 12-bit gain values supplied by the updater 254. The output of multiplier 82 is then applied to a truncator 224 providing a 12-bit output on the associated output bus to the gamma look-up table 40' which stores the results of the gamma look-up table 40 loaded from EEPROM 180. The 12-bit output of LUT 40' is then applied to the dithering circuit 30' which is driven by a dither matrix 30 (supplied by the configuration memory 230) and an enable signal as shown.

The temperature measurement or calculation is typically updated for instance once per second of 10 times per second, so the temperature or virtual temperature is measured or calculated at these intervals.

The controller 46 of FIGS. 6 to 10 thereby embodies aspects in accordance with the invention. So does the display apparatus of FIG. 5 which includes the display panel and the video rendering chip 69 with its associated memory 72 and microprocessor 70 which are the hardware (circuitry) which embody the functionality of the controller 46 together with the display and display driver.

Not illustrated but readily understood is an associated system such as a computer system or television set including the display 10 and further including other circuitry. For instance, in the case of a television set this would also include a television tuner or equivalent and a user input device for changing channels, etc. In the case of a computer this would also include the computer CPU, random access memory, non-volatile storage, connecting and interface buses, and user input devices, all of which are conventional.

This disclosure is illustrative and not limiting. Further embodiments, modifications and improvements will be apparent to those skilled in the art in light of this disclosure, and are intended to fall within the scope of the appended claims.

We claim:

1. A method of correcting characteristics of a display, comprising the acts of:

for a display unit, determining a per-unit gamma correction, a per-unit white point correction, and a per-unit gray tracking correction;

determining a set of generic gain corrections for a plurality of temperatures for the display unit; and storing the determined corrections in a computer readable memory associated with the display unit, whereby in use, the display unit applies the stored corrections to a displayed image.

2. The method of claim 1, wherein the gain corrections are normalized for a plurality of display units.

3. The method of claim 1, wherein each of the gamma, gray tracking and white point corrections is determined, and each is determined unit-by-unit.

4. The method of claim 1, wherein determining the gain corrections includes:

measuring temperatures at a plurality of locations adjacent the display unit;

combining the measured temperatures into one value; and associating the one value with a set of gain correction values.

5. The method of claim 4, wherein the one value is a function of a temperature of the display at a center of its screen.

6. The method of claim 1, wherein the plurality of temperatures are up to a full warm up of the display unit.

7. The method of claim 1, wherein the computer readable memory is organized as a look up table and is a programmable read only memory device.

8. The method of claim 1, wherein the storing includes:

transmitting at least one of the corrections to a video input port of the display; and coupling the at least one of the corrections from the video input port to the computer readable memory.

9. A computing apparatus that carries out the method of claim 1.

10. A display unit comprising:

a screen;

a display driver coupled to drive the screen; and a controller coupled to receive image data to display on the screen and to output the data to the display driver, the controller including:

a computer readable memory storing for the display unit, a gamma correction, a white point correction, and a set of gain corrections for a plurality of temperatures;

at least one combiner adapted to combine the corrections with the image data; and an output port coupled to the combiner and to the display driver.

11. The display unit of claim 10, further comprising a second combiner coupled to combine the white point correction and set of gain corrections.

12. The display unit of claim 10, further comprising:

an input temperature port coupled to receive a temperature parameter; and a logic coupled to the input temperature port and a portion of the computer readable memory storing the set of gain corrections.

13. The display unit of claim 12, wherein the temperature parameter is a function of a plurality of temperatures sensed adjacent the display.

14. The display unit of claim 12, further comprising a plurality of temperature sensors disposed adjacent the display; and a logic coupled to each of the temperature sensors; wherein the logic computes the temperature parameter from data provided by the temperature sensors.

15. The display unit of claim 14, wherein initially the temperature parameter is one of the plurality of sensed temperatures or a predetermined value, and thereafter the temperature parameter is computed by the logic.

16. The display unit of claim 10, wherein the computer readable memory is at least partly on the same integrated circuit as the controller and display driver.

17. The display unit of claim 10, wherein the computer readable memory stores a gray tracking correction for the display unit.

18. A method of operating a display unit having a screen driver driven by a controller, the controller being coupled to receive image data to display on the screen and to output data to the screen, the method comprising the acts of:

storing in a computer readable memory a gamma correction, a white point correction, and a set of gain corrections for a plurality of temperatures;

correcting the image data, wherein correcting the image data comprises:

applying the gamma correction to the image data, applying the white point correction to the image data, and applying the set of gain corrections to the image data; and outputting the image data to the screen.

19. A controller adapted to control a display unit, the controller comprising:

an input port adapted to received image data;

an output port adapted to drive the display unit;

a computer readable memory storing for the display unit a temperature-independent gamma correction, a temperature-independent white point correction, and a temperature-dependent set of gain corrections for a plurality of temperatures; and at least one combiner coupled to combine the temperature-independent gamma correction, the temperature-independent white point correction, and the temperature-dependent set of gain corrections with the image data; wherever an output port of the combiner is coupled to the output port.

20. The method defined in claim 18, wherein correcting the image data by applying the gamma correction, the white point correction, and the set of gain corrections to the image data comprises:

generating a combined correction by combining the set of gain corrections and the white point correction; and combining the image data with the combined correction.

* * * * *